US006349911B1

(12) United States Patent
Feldpausch et al.

(10) Patent No.: US 6,349,911 B1
(45) Date of Patent: Feb. 26, 2002

(54) WORKPLACE APPARATUS INCLUDING MOUNTING BRACKET

(75) Inventors: Michael J. Feldpausch, Hastings; Daniel Grabowski, Grand Rapids, both of MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/472,371

(22) Filed: Dec. 23, 1999

(51) Int. Cl.[7] ..... A47G 29/02

(52) U.S. Cl. ..... 248/243; 248/247; 248/250; 211/90.02

(58) Field of Search ..... 248/244, 243, 248/247, 220.31, 225.21, 220.41, 157, 220.22, 241; 211/90.01, 90.02, 187, 94.01

(56) References Cited

U.S. PATENT DOCUMENTS

| | | | | | |
|---|---|---|---|---|---|
| 391,438 | A | * | 10/1888 | Van Horn | 248/244 |
| 1,055,201 | A | | 3/1913 | Mason | |
| 1,938,370 | A | | 12/1933 | Bodkin | 248/19 |
| 2,928,512 | A | | 3/1960 | Slater et al. | 189/36 |
| 3,697,034 | A | | 10/1972 | Shell | 248/243 |
| 3,888,440 | A | | 6/1975 | Rebentisch | 248/73 |
| 4,004,856 | A | | 1/1977 | Wesseler | 403/186 |
| 4,607,753 | A | | 8/1986 | Radek | 211/87 |
| 4,678,151 | A | | 7/1987 | Radek | 248/220 |
| 4,819,900 | A | * | 4/1989 | Funk | 248/244 |
| 5,101,989 | A | | 4/1992 | Jones | 211/94 |
| 5,110,080 | A | | 5/1992 | Rieman | 248/225.1 |
| 5,332,108 | A | | 7/1994 | Blass | 211/90 |
| 5,477,971 | A | * | 12/1995 | Howard | 211/187 |
| 5,582,116 | A | | 12/1996 | Spimpolo | 108/108 |
| 5,697,507 | A | | 12/1997 | Blass | 211/94 |
| 5,746,034 | A | | 5/1998 | Luchetti et al. | 52/220.7 |
| 5,746,035 | A | | 5/1998 | Seiber et al. | 52/238.1 |
| 5,816,001 | A | | 10/1998 | Goodman et al. | 52/239 |
| D404,873 | S | | 1/1999 | Simons et al. | D34/19 |
| D407,501 | S | | 3/1999 | Shipman et al. | D25/58 |
| D407,587 | S | | 4/1999 | Grabowski | D6/511 |
| D408,355 | S | | 4/1999 | Welsh et al. | D13/139.4 |
| 5,890,325 | A | | 4/1999 | Corcorran et al. | 52/36.1 |
| 5,931,429 | A | | 8/1999 | Hellwig et al. | 248/235 |

* cited by examiner

*Primary Examiner*—Anita King
*Assistant Examiner*—Korie H. Chan
(74) *Attorney, Agent, or Firm*—Price, Heneveld, Cooper, DeWitt & Litton

(57) ABSTRACT

An apparatus having a partition with a frame, a worksurface and a bracket assembly. The bracket assembly supports a rear edge of the worksurface to the frame at a selected location on a horizontally extending attachment feature included on the frame. The bracket assembly includes a partition-engaging bracket configured to securely engage the horizontally extending attachment feature, a worksurface-engaging bracket configured to securely engage the rear edge of the worksurface, and an interconnecting bracket. The partition-engaging bracket and the interconnecting bracket include horizontally-extending overlapping flanges. The worksurface-engaging bracket is configured to interlockingly secure the horizontally-extending overlapping flanges together in a vertically adjusted selected position.

30 Claims, 5 Drawing Sheets

WORKPLACE APPARATUS INCLUDING MOUNTING BRACKET

BACKGROUND OF THE INVENTION

The present invention relates to bracket assemblies, and in particular to a workplace apparatus including a mounting bracket.

Attachment brackets are often used to support shelves and the like on vertical panels. For example, in the furniture industry, attachment brackets are often used to support a rear edge of a furniture component, such as a bookshelf, a desk, or a table. In the retail business, product shelves and display surfaces are often similarly supported by attachment brackets. In many shelf and bracket systems, the bracket is first attached to the shelf, and then the shelf is releasably attached to a vertical panel. In partitions, the vertical panel often includes vertical uprights at its horizontal side edges, with the uprights including vertically spaced attachment slots, and the brackets are adapted to releasably engage selected ones of the vertically spaced attachment slots. Gravity and potentially friction hold the attachment brackets in engagement with the vertically spaced attachment slots. If a new height is desired, the bracket is liftingly disengaged, and then re-engaged at a newly selected height.

Recently, a completely new freestanding partition system was designed that provides horizontal adjustability of partition-attached furniture components. (See U.S. Pat. No. 5,746,035.) The partition system includes vertical partition panels having horizontal frame members with horizontally spaced attachment slots provided for releasable engagement by attachment brackets. This system is highly advantageous in that it provides horizontal adjustability, allowing the user to position furniture components wherever they desire horizontally along the partition panel. However, the partition panels no longer provide vertical adjustability. This can be problematic, since the horizontally spaced attachment slots may not always be at an optimal height to a floor surface. For example, partition panels include levelers that are vertically adjustable up to three or more inches. This allows the partition panels to be aligned despite uneven floor surfaces. However, when the levelers are adjusted to an upper limit or a lower limit, the horizontally spaced attachment slots may be ergonomically too high or too low to optimally support a worksurface. Further, it is desirable to provide some vertical adjustability so that worksurfaces can be customized and adjusted for a particular worker. It is expensive and inefficient to provide multiple brackets for supporting the worksurface at different heights. Further, it is highly desirable to provide a single vertically adjustable bracket that is configured to selectively engage the horizontally spaced attachment slots that is low cost, simple in its construction and assembly, flexible in its use, and easy and fool-proof to install. Still further, it is highly desirable for the bracket to maintain a thin depth dimension so that it can be attached to a front of a partition panel without extending significantly forward from a face of the partition panel. Also, it is desirable to provide a bracket that requires minimal use of tools.

Accordingly, an apparatus solving the aforementioned disadvantages and having the aforementioned advantages is desired.

SUMMARY OF THE INVENTION

One aspect of the present invention is to provide a bracket assembly including a partition-engaging bracket configured to securely engage a horizontally extending attachment feature, a worksurface-engaging bracket configured to securely engage a rear edge of a worksurface, and an interconnecting bracket. The partition-engaging bracket and the interconnecting bracket include horizontally-extending overlapping flanges, and the worksurface-engaging bracket is configured to interlockingly secure the horizontally-extending overlapping flanges together in a vertically adjusted selected position.

Another aspect of the present invention is to provide a workplace apparatus that includes a partition, a worksurface and a bracket assembly. The partition includes a frame having a horizontally extending attachment feature adapted to support the worksurface at a selected location on the horizontally extending attachment feature. The bracket assembly includes a partition-engaging bracket configured to securely engage the horizontally extending attachment feature, a worksurface-engaging bracket configured to securely engage the rear edge of the worksurface, and an interconnecting bracket. The partition-engaging bracket and the interconnecting bracket include horizontally-extending overlapping flanges, and the worksurface-engaging bracket is configured to interlockingly secure the horizontally-extending overlapping flanges together in a vertically adjusted selected position.

The present invention is intended to provide a workplace apparatus that has a worksurface that is vertically adjustable. The workplace apparatus can be easily and quickly assembled. The bracket assembly for the workplace apparatus provides simple construction and assembly with minimal use of tools. The bracket assembly also provides secure vertical adjustment without fasteners and a thin profile. The workplace apparatus is efficient in use, economical to manufacture, capable of a long operable life, and particularly adapted for the proposed use.

These and other features, advantages, and objects of the present invention will be further understood and appreciated by those skilled in the art by reference to the following specification, claims and appended drawings.

DETAILED DESCRIPTION OF THE PREFERRED EMBODIMENTS

Figure 1:
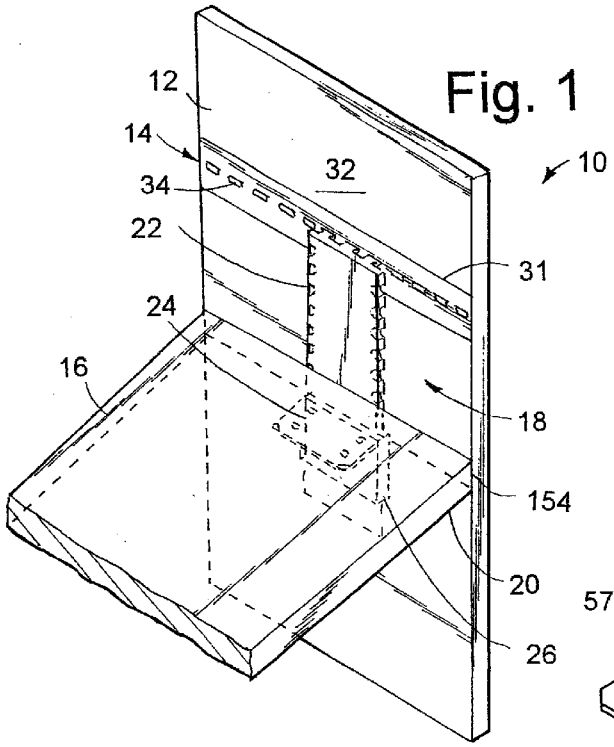
FIG. 1 is a perspective view of a workplace apparatus embodying the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 4:
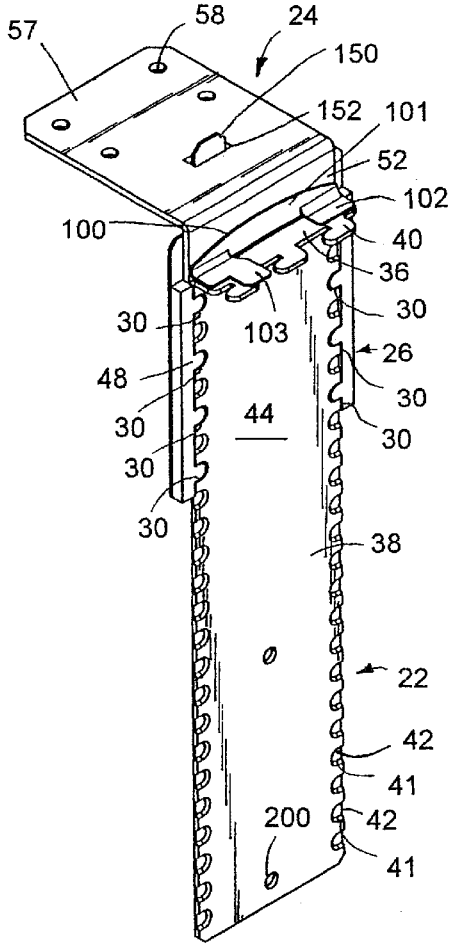
FIG. 4 is a front isometric view of the bracket assembly of the first alternative embodiment of the present invention.

The reference number 10 (FIG. 1) generally designates a workplace apparatus embodying the present invention. In the illustrated example, the workplace apparatus 10 includes a partition 11 having a frame with a horizontal frame member 12 including a horizontally extending attachment feature 14. The partition 11 is sufficiently described herein for an understanding of the present invention, but it is noted that the partition is described in greater detail in Seiber et al., U.S. Pat. No. 5,746,035, issued May 5, 1998, entitled PARTITON SYSTEM, the entire contents of which are incorporated herein. The workplace apparatus 10 also includes a worksurface 16 and a bracket assembly 18. The bracket assembly 18 supports a rear edge 20 of the worksurface 16 to the frame member 12 at a selected location on the horizontally extending attachment feature 14. The bracket assembly 18 includes a partition-engaging bracket 22 configured to securely engage the horizontally extending attachment feature 14, a worksurface-engaging bracket 24 configured to securely engage the rear edge 20 of the worksurface 16, and an interconnecting bracket 26. FIG. 4 shows that the partition-engaging bracket 22 and the interconnecting bracket 26 include horizontally-extending overlapping flanges 30, with the worksurface-engaging bracket 24 being configured to interlockingly secure the horizontally-extending overlapping flanges 30 together in a vertically adjusted selected position.

In the illustrated example, the horizontally extending attachment feature 14 of the frame member 12 is a horizontal strip 31 integrally formed on an inside face 32 of the frame member 12. The horizontal strip 31 includes horizontal mating slots 34 for connecting to the partition-engaging bracket of the bracket assembly 18. The horizontal mating slots 34 allow the bracket assembly 18 to be placed anywhere along a width of the frame member 12.

Figure 3:
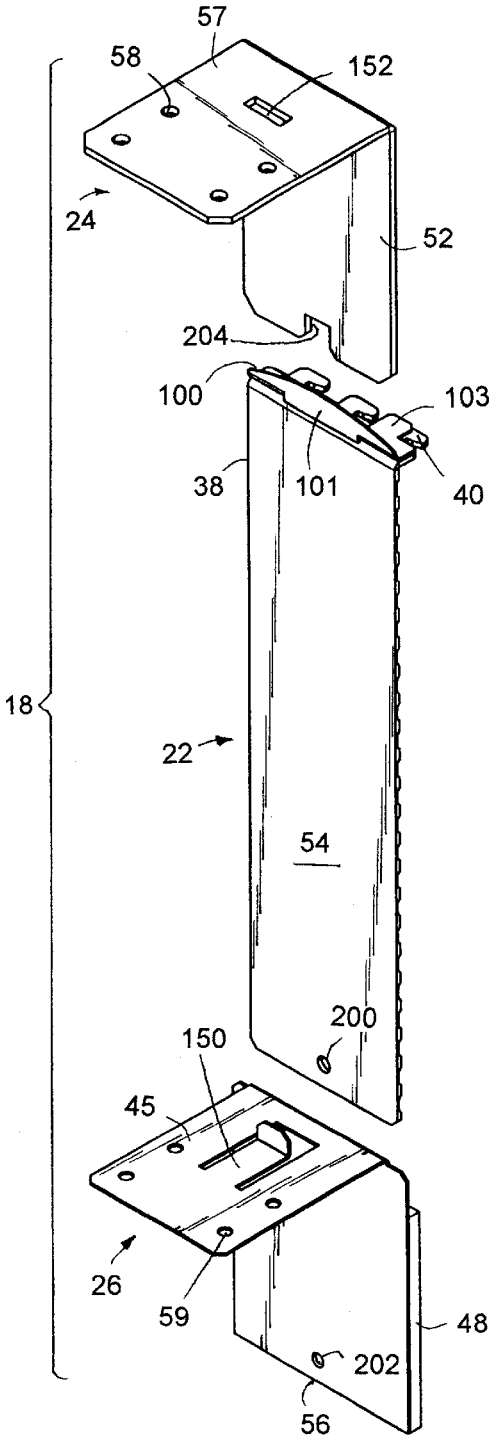
FIG. 3 is a back exploded view of the bracket assembly of the first alternative embodiment of the present invention.
Figure 2:
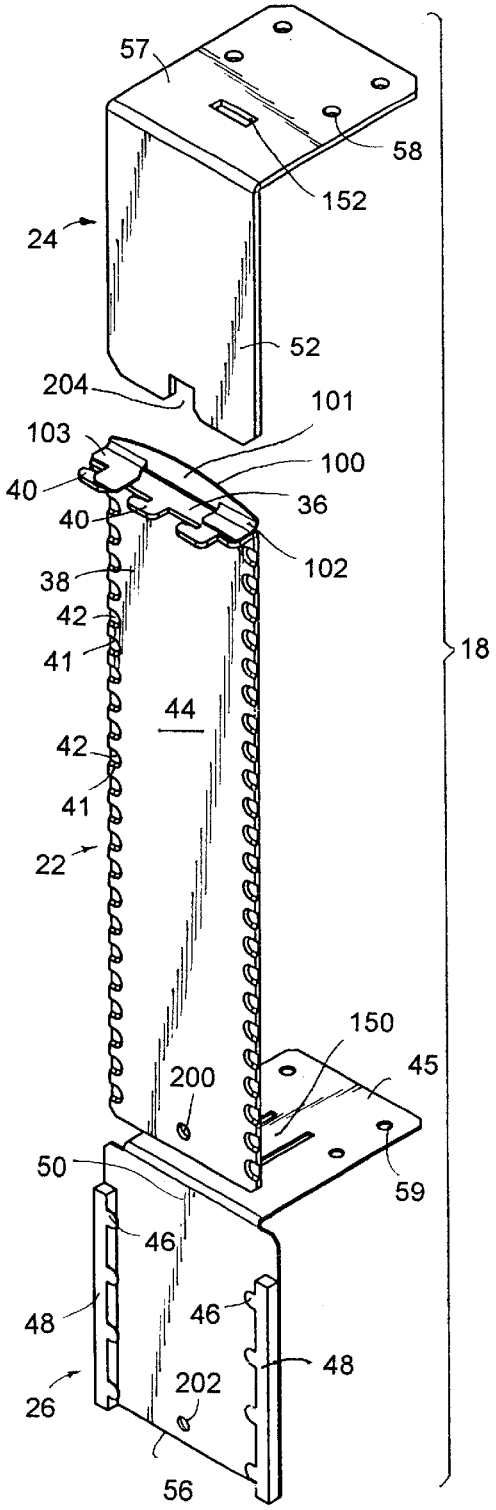
FIG. 2 is a front exploded view of the bracket assembly of the first alternative embodiment of the present invention.

The illustrated partition-engaging bracket 22 (FIGS. 2–4) is L-shaped and includes a substantially horizontal portion 36 and a substantially vertical portion 38. Preferably, the horizontal portion 36 has three horizontally extending feet or hooks 40. The horizontally extending feet 40, during assembly of the workplace apparatus 10, are slid into the horizontal mating slots 34 of the horizontally extending attachment feature 14 and include an elongated narrow throat that securely engages the sheet metal thickness of the frame member 12 so that they are securely held therein. Furthermore, the substantially horizontal portion 36 preferably has a lock spring anti-dislodgment feature 100 attached to the top of the substantially horizontal portion 36. The lock spring anti-dislodgment feature 100 has a first strip 102, a center portion 101 and a locking tab 103. The first strip 102 is secured to the top of one side of the substantially horizontal portion 36 and connects the lock spring anti-dislodgment feature 100 to the partition-engaging bracket 22. The center portion 101 is substantially parallel to the feet 40 and is connected to the first strip 102. The center portion 101 of the lock spring anti-dislodgment feature 100 is a leaf spring that will force the locking tab 103 into locking engagement with one of the horizontal mating slots 34 of the horizontally extending attachment feature 14.

In a first preferred embodiment, the horizontally-extending overlapping flanges 30 of the partition-engaging bracket 22 are made of vertically arranged ledges 41 defined by depressions 42 in a first substantially planar face 44 on the substantially vertical portion 38 of the partition-engaging bracket 22. The depressions 42 are preferably made by coining opposing edges of a flat plate. It is contemplated that the depressions 42 can be made by manufacturing through notches in a first flat plate and laminating a second plate over the first flat plate in order to make the horizontally-extending overlapping flanges 30 of the partition-engaging bracket 22. The distance between two pairs of depressions 42 preferably is 0.5 inches. It is contemplated that other increments could be employed to optimize the desired arrangement. For example, the increments could be increased in order to optimize the weight capacity allowed on the worksurface 16, or the increments could be lessened in order to reduce the amount of materials used. It is contemplated that the horizontally-extending overlapping flanges 30 of the partition-engaging bracket 22 could have many shapes.

In the illustrated example, the interconnecting bracket 26 (FIGS. 2–5) is L-shaped and includes a substantially horizontal portion 45 and a substantially vertical portion 56. The horizontally-extending overlapping flanges 30 of the interconnecting bracket 26 are made of vertically arranged fingers 46. The cross-section of the substantially vertical portion 56 of the interconnecting bracket 26 is substantially U-shaped, wherein at least one pair of the fingers 46 extend toward each other from side walls 48. Preferably, the substantially vertical portion 56, the side walls 48 and the fingers 46 are individual pieces that are welded together to form the interconnecting bracket 26.

In a preferred embodiment, the fingers 46 are similar in shape and size as the depressions 42 and the distance between two vertically spaced fingers 46 on the interconnecting bracket 26 is the same distance between two vertically spaced depressions 42 on the partition-engaging bracket 22. Therefore, as the dimensions of the increments between the depressions 42 on the partition-engaging bracket 22 become smaller, the size of the interconnecting bracket 26 will correspondingly become reduced in size because the increments between the fingers 46 will become smaller. Moreover, it is contemplated that the horizontally-extending overlapping flanges 30 of the interconnecting bracket 26 could have many shapes as long as the horizontally-extending overlapping flanges 30 of the interconnecting bracket 26 interlock with the horizontally-extending overlapping flanges 30 of the partition-engaging bracket 22.

In the illustrated example, the workplace apparatus 10 is erected by first pushing the horizontally extending feet 40 into the mating slots 34 of the horizontally extending attachment feature 14. Once the horizontally extending feet 40 are fully engaged into the mating slots 34, the lock spring anti-dislodgment feature 100 is released. The locking tab 103 of the lock spring anti-dislodgment feature 100 then slides into one of the mating slots 34 already engaged by one of the feet 40, thereby preventing lateral movement of the horizontally extending feet 40.

The interconnecting bracket 26 is then slid up the substantially vertical portion 38 of the partition-engaging bracket 22 until a desired height for the worksurface 16 is reached. The partition-engaging bracket 22 is slid through a recess 50 in the interconnecting bracket 26 defined by the fingers 46, the substantially vertical portion 56 of the interconnecting bracket 26, and the side walls 48 of the interconnecting bracket 26. The fingers 46 of the interconnecting bracket 26 are engaged with the depressions 42 by pulling the fingers 46 towards the substantially planar face 44 until the fingers 46 are within the depressions 42 of the partition-engaging bracket 22. A vertical portion 52 of the worksurface-engaging bracket 24 is then slid into the recess 50 between a second substantially planar face 54 of the partition-engaging bracket, the substantially vertical portion 56 of the interconnecting bracket 26 and the side walls 48 of the interconnecting bracket 26. Therefore, the worksurface-engaging bracket 24 is located between the partition-engaging bracket 22 and the interconnecting bracket 26. The width of the vertical portion 52 of the worksurface-engaging bracket 24 is such that the fingers 46 of the interconnecting bracket 26 cannot disengage from the depressions 42 of the partition-engaging bracket 22 until the worksurface-engaging bracket 24 is removed from the recess. Therefore, the worksurface-engaging bracket 24 interlockingly secures the horizontally-extending overlapping flanges 30 together in a vertically adjusted selected position. In an alternative embodiment of the invention (not shown), the interconnecting bracket 26 has indentations on opposite side edges of the substantially horizontal portion 45 to allow the worksurface-engaging bracket 24 to be easily removed from the recess 50.

Thereafter, the worksurface 16 is secured to the worksurface-engaging bracket 24 by first sliding the worksurface 16 on a substantially horizontal portion 57 of the worksurface-engaging bracket 24 towards the second substantially planar face 54 of the partition-engaging bracket 22. The substantially horizontal portion 57 of the worksurface-engaging bracket 24 is preferably made from a unitary bent piece of sheet metal.

Figure 5:
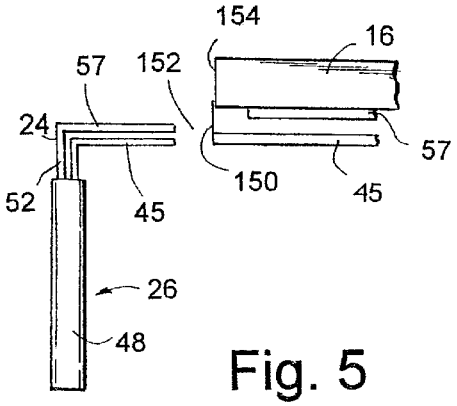
FIG. 5 is a cross-sectional view of the worksurface-engaging bracket, the worksurface and the variable stop of the first alternative embodiment of the present invention in the stop position.
Figure 6:
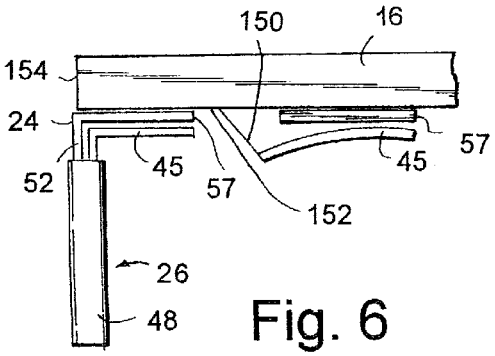
FIG. 6 is a cross-sectional view of the worksurface-engaging bracket, the worksurface and the variable stop of the first alternative embodiment of the present invention in the pass position.

As seen in FIGS. 2–6, the substantially horizontal portion 45 of the interconnecting bracket 26 preferably has a variable stop 150 in the center of the substantially horizontal portion 45. The variable stop 150 is a leaf'spring that protrudes through a window 152 in the substantially horizontal portion 57 of the worksurface-engaging bracket 24. If a gap is desired between the worksurface 16 and the second substantially planar face 54 of the partition-engaging bracket 22, the worksurface 16 is slid along the substantially horizontal portion 45 of the interconnecting bracket 26 until a side edge 154 of the worksurface 16 meets the variable stop 150 in a stop position (FIG. 5). Therefore, the variable stop 150 will stop the worksurface 16 from coming into contact with the partition-engaging bracket 22. If a gap is not desired between the worksurface 16 and the second substantially planar face 54 of the partition-engaging bracket 22, the worksurface 16 is placed on top of the substantially horizontal portion 57 of the worksurface-engaging bracket 24 and the variable stop 150 in a pass position (FIG. 6). The variable stop 150 is then pressed down and the side edge 154 of the worksurface 16 can be placed adjacent the partition-engaging bracket 22.

As a final step, the worksurface 16 is secured to the bracket assembly 18 by placing fasteners (not shown) through aligned apertures 58 in the worksurface-engaging bracket 24 and apertures 59 in the substantially horizontal portion 45 of the interconnecting bracket 26 and securing the fasteners to the rear face 20 of the worksurface 16 near the side edge 154 of the worksurface 16. The fasteners also prevent disengagement of the horizontally-extending overlapping flanges 30 by securing the worksurface-engaging bracket 24 in place. The order of attaching the bracket assembly 18 to the worksurface 16 and the frame member 12 is not important. It is contemplated that the workplace apparatus 10 will be erected by securing the worksurface-engaging bracket 24 to the worksurface 16 after attaching the combined bracket assembly 18 to the frame member 12.

In the illustrated example (FIGS. 2–4), the substantially vertical portion 38 of the partition-engaging bracket 22 has a first emboss 200 at the bottom of the substantially vertical portion 38. Likewise, the substantially vertical portion 56 of the interconnecting bracket 26 has a companion second emboss 202 at the bottom of the substantially vertical portion 56. The first emboss 200 and the second emboss 202 act as an interference stop so that the interconnecting bracket 26 will not disconnect from the partition-engaging bracket 22 without a relative downward force applied to the interconnecting bracket 26. Moreover, the bottom of the substantially vertical portion 52 of the worksurface-engaging bracket 24 has a notch 204 which allows the interconnecting bracket 26 to be placed at the bottom of the partition-engaging bracket 22 and the worksurface-engaging bracket 24 to be placed within the recess 50 without the first emboss 200 and the second emboss 202 obstructing the worksurface-engaging bracket 24.

Figure 8:
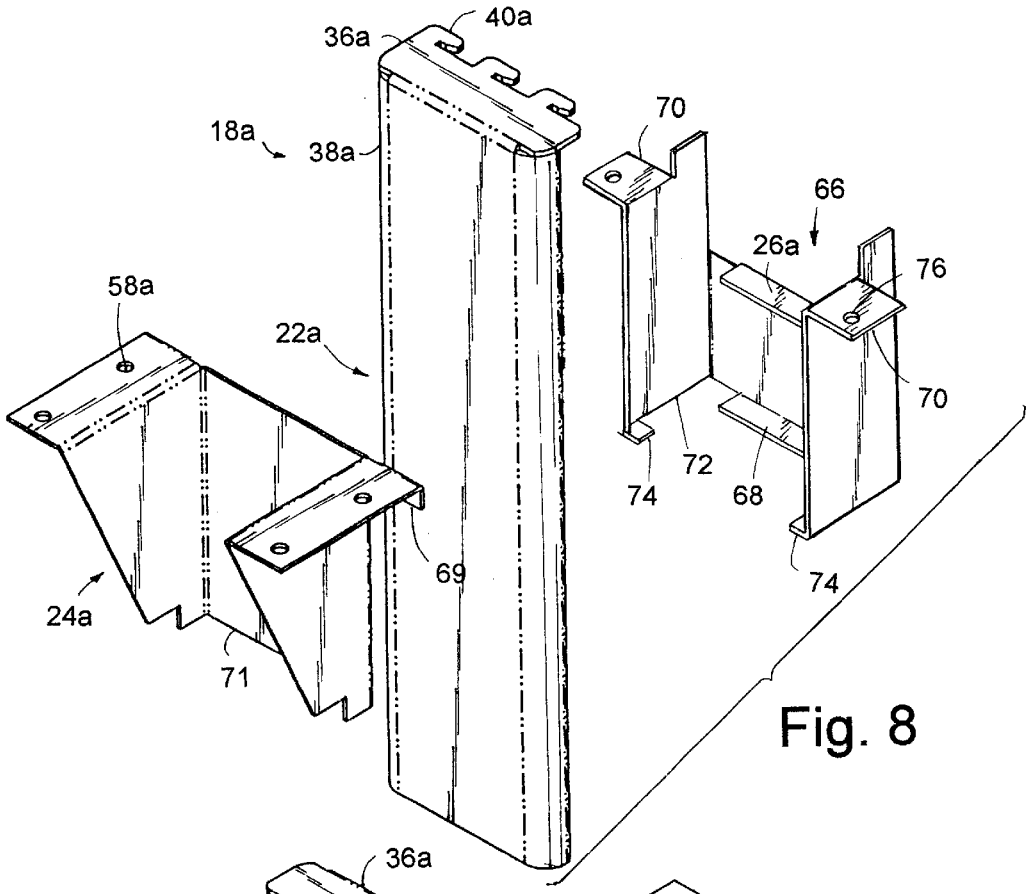
FIG. 8 is a back exploded view of a second alternative embodiment of bracket assembly of the present invention.
Figure 7:
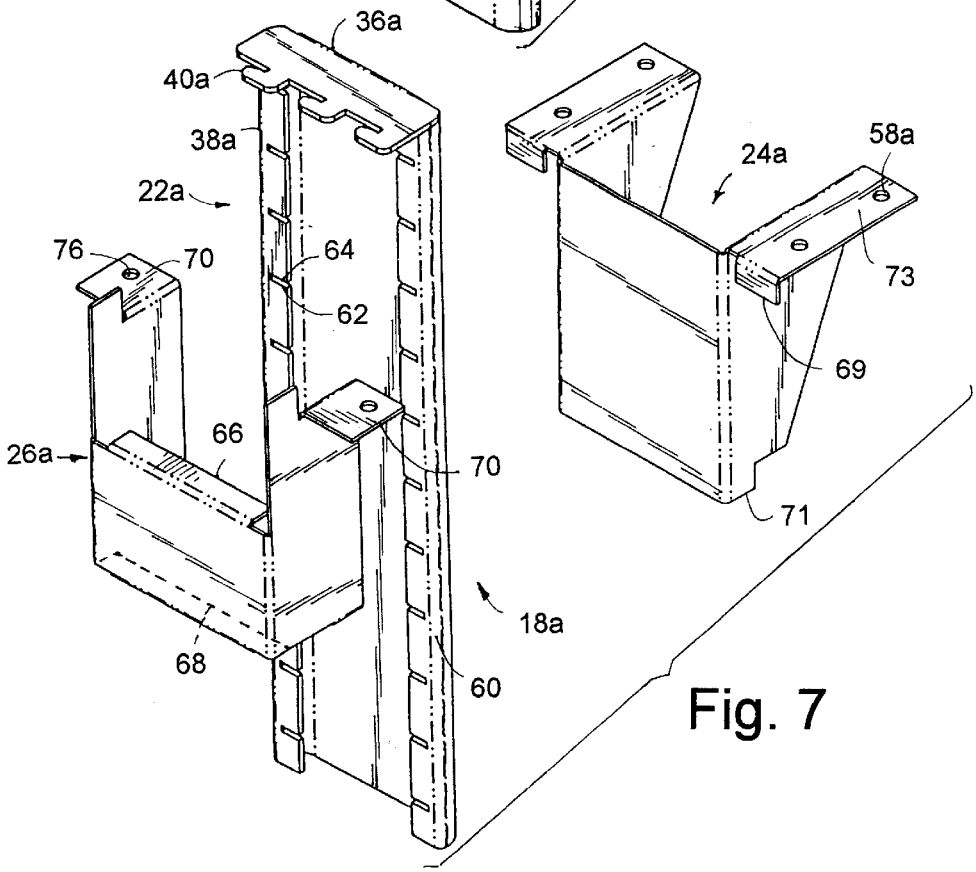
FIG. 7 is a front exploded view of a second alternative embodiment of bracket assembly of the present invention.
Figure 9:
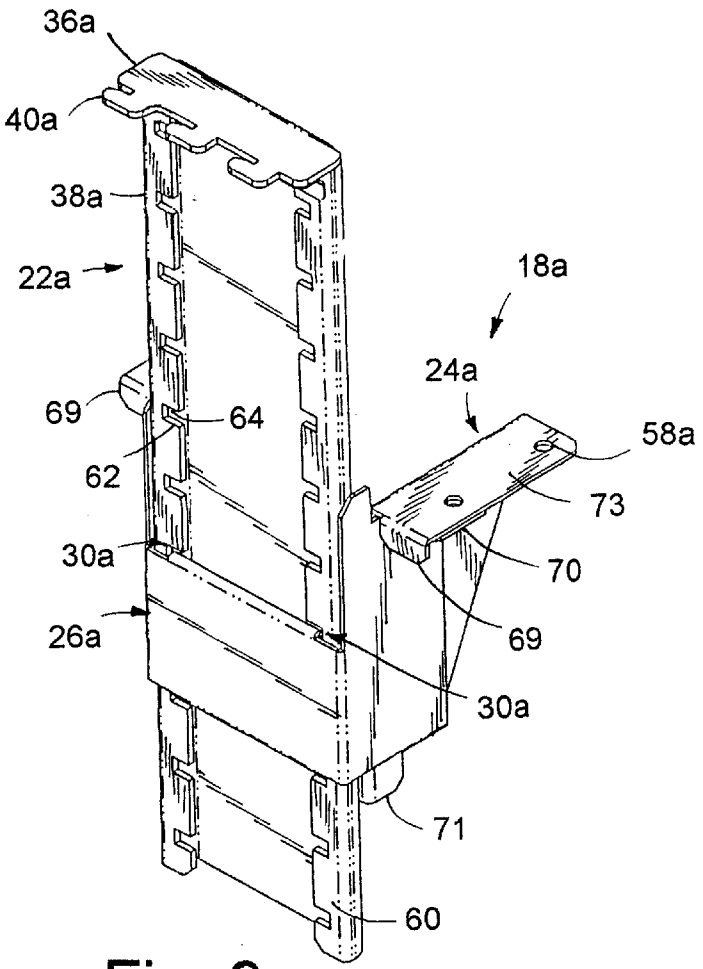
FIG. 9 is a front isometric view of the bracket assembly of the second alternative embodiment of the present invention.

The reference numeral 18*a* (FIGS. 7–10) generally designates another embodiment of the present invention, having a second embodiment for the bracket assembly. Since bracket assembly 18*a* is similar to the previously described bracket assembly 18, similar parts appearing in FIGS. 2–4 and FIGS. 6–9, respectively, are represented by the same, corresponding reference number, except for the suffix "a" in the numerals of the latter. The bracket assembly 18*a* is comprised of a partition-engaging bracket 22*a*, a worksurface-engaging bracket 24*a* and an interconnecting bracket 26*a*. FIG. 8 shows that the partition-engaging bracket 22*a* and the interconnecting bracket 26*a* include horizontally-extending overlapping flanges 30*a*, with the worksurface-engaging bracket 24*a* being configured to interlockingly secure the horizontally-extending overlapping flanges 30*a* together in a vertically adjusted selected position.

The illustrated partition-engaging bracket 22*a* (FIGS. 7–10) is L-shaped and includes a substantially horizontal portion 36*a* and a substantially vertical portion 38*a*. The horizontal portion 36*a* has three horizontally extending feet 40*a*. The horizontally extending feet 40*a*, during assembly of the workplace apparatus 10, are slid into the horizontal mating slots 34 of the horizontally extending attachment feature 14 and are securely held therein.

In the second preferred embodiment, the vertical portion 38*a* of the partition-engaging bracket 22*a* has a C-shaped cross section. The horizontally-extending overlapping flanges 30*a* of the partition-engaging bracket 22*a* are made of shelves 62 divided by associated slots 64 on the vertically running end walls 60 of the substantially vertical portion 38*a*. Correspondingly, the horizontally-extending overlapping flanges 30*a* of the interconnecting bracket 26*a* are made of a first inclined plate 66 and a second inclined plate 68. Both the first inclined plate 66 and the second inclined plate 68 slope relatively downward in order to facilitate the engagement of the overlapping flanges 30*a*. The distance between the first inclined plate 66 and the second inclined plate 68 on the interconnecting bracket 26*a* is the same distance between correspondingly spaced slots 64 on the partition-engaging bracket 22*a*.

In the illustrated example, the workplace apparatus 10 using the bracket assembly 18*a* of the second preferred embodiment is erected by sliding the horizontally extending feet 40*a* of the partition-engaging bracket 22*a* into the horizontal mating slots 34 at a desired location on the horizontally extending attachment feature 14. The interconnecting bracket 26*a* is then connected to the substantially vertical portion 38*a* of the partition-engaging bracket 22*a* by sliding the inclined plates 66 and 68 downward and into a desired pair of slots 64 until a desired height for the worksurface 16 is reached. The interconnecting bracket 26*a* is then interlockingly secured to the partition-engaging brackets 22*a* by simultaneously inserting a projecting bottom 71 of the worksurface-engaging bracket 24*a* into a recess 72 defined by projections 74 on the bottom of the interconnecting bracket 26*a* and sliding extensions 69 located on a worksurface-engaging face 73 of the worksurface-engaging bracket 24*a* over lips 70 on the interconnecting bracket 26*a*. Therefore, the partition-engaging bracket 22*a* is located between the worksurface-engaging bracket 22*a* and the interconnecting bracket 26*a*. Moreover, the worksurface-engaging bracket 24*a* interlockingly secures the horizontally-extending overlapping flanges 30*a* together in a vertically adjusted selected position. Finally, the worksurface 16 is secured to the worksurface-engaging bracket 24*a* by placing fasteners (not shown) through overlapping apertures 58*a* in the worksurface-engaging bracket 24*a* and apertures 76 in the interconnecting bracket 26*a*, and securing the fasteners to an underside of the worksurface 16 at the rear face 20 of the worksurface 16. The fasteners also prevent disengagement of the horizontally-extending overlapping flanges 30*a* by securing the worksurface-engaging bracket 24*a* in place. The order of attaching the bracket assembly 18*a* to the worksurface 16 and the frame member 12 is not important.

The reference numeral 22*b* (FIG. 11) generally designates another embodiment of the present invention, having a third embodiment for the partition-engaging bracket. Since partition-engaging bracket 22*b* is similar to the previously described partition-engaging bracket 22, similar parts appearing in FIGS. 2–4 and FIG. 10, respectively, are represented by the same, corresponding reference number, except for the suffix "b" in the numerals of the latter.

Figure 10:
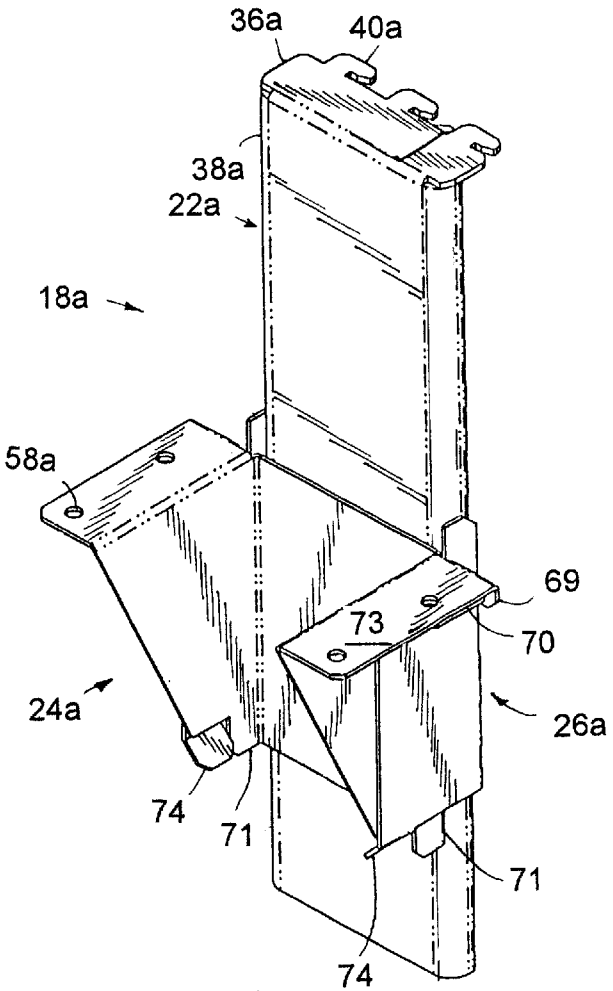
FIG. 10 is a back isometric view of the bracket assembly of the second alternative embodiment of the present invention.
Figure 11:
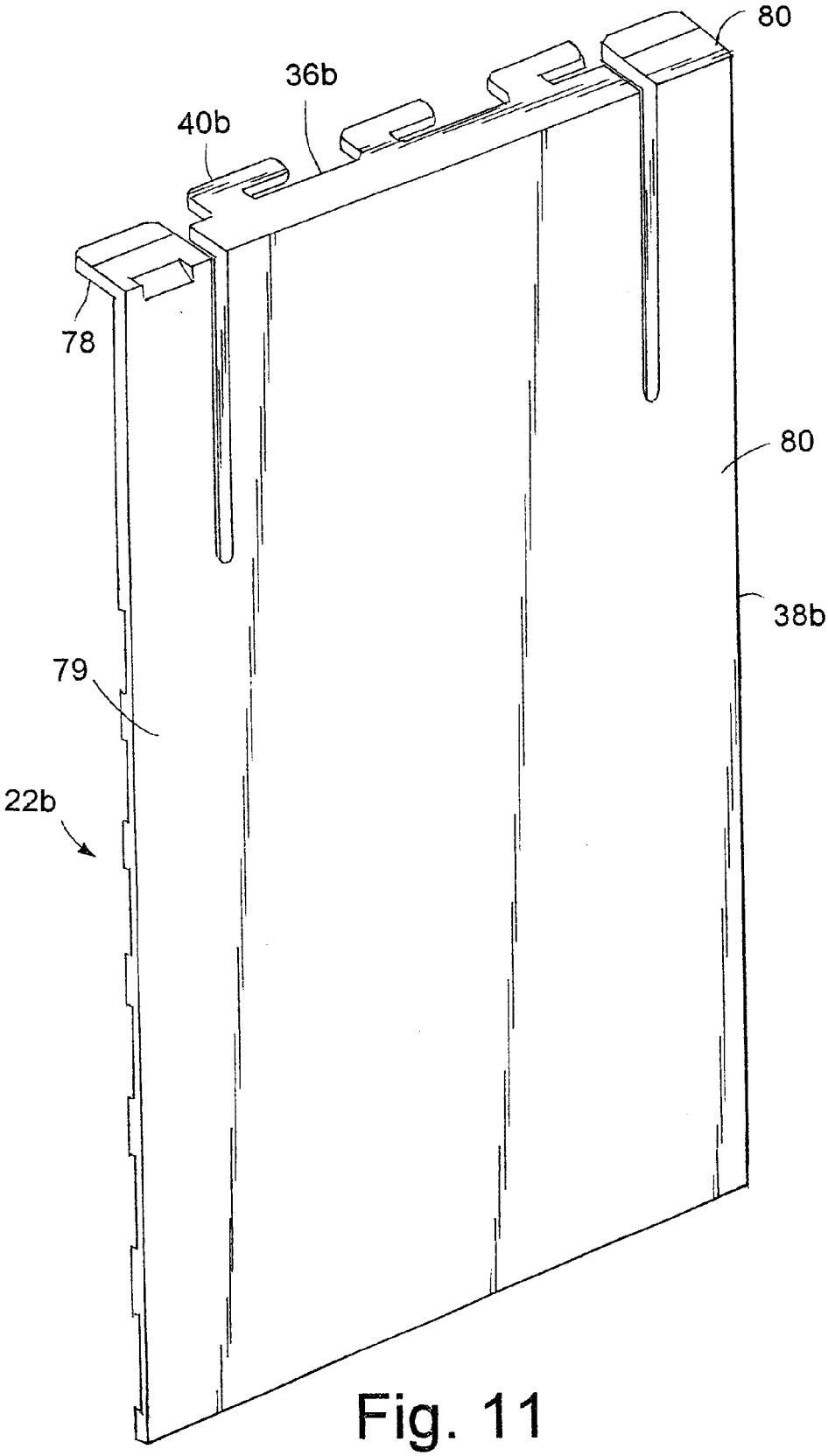
FIG. 11 is an isometric view of a third alternative embodiment of the partition-engaging bracket of the present invention.

The illustrated partition-engaging bracket 22*b* is L-shaped and includes a substantially horizontal portion 36*b* and a substantially vertical portion 38*b*. The horizontal portion 36*b* has three horizontally extending feet 40*b*. The horizontally extending feet 40*b*, during assembly of the workplace apparatus 10, are slid into the horizontal mating slots 34 of the horizontally extending attachment feature 14 and are interlockingly secured. The partition-engaging bracket 22*b* also includes a first adjacent locking tab 78. The first adjacent locking tab 78 is L-shaped and extends from a first side 79 of a substantially vertical portion 38*b* of the partition-engaging bracket 22*b*. During assembly of the workplace apparatus 10 using the third embodiment of the partition-engaging bracket 22*b*, the horizontally extending feet 40*b* are slid into the mating slots 34 of the horizontally extending attachment feature 14. Once the horizontally extending feet 40*b* are fully engaged into the mating slots 34, the first adjacent locking tab 78 then slides into one of the mating slots 34 adjacent the mating slots 34, thereby preventing lateral movement of the horizontally extending feet 40*b*. As illustrated in FIG. 10, it is contemplated that a second adjacent locking tab 80 located on a second side 82 of the substantially vertical portion 38*b* could also be used. The second adjacent locking tab 80 functions in the same manner and produces the same locking force as the first adjacent locking tab 78. The first adjacent locking tab 78 could be employed along with the second adjacent locking tab 80, or the first adjacent locking tab 78 and the second adjacent locking tab 80 could be used individually on the partition-engaging bracket 22*b*. The first adjacent locking tab 78 and the second adjacent locking tab 80 of the third preferred embodiment can be substituted for the lock-spring anti-dislodgment feature 100 on the partition-engaging bracket 22 of the first preferred embodiment or employed on the partition-engaging bracket 22*a* of the second preferred embodiment.

In the forgoing description, it will be readily appreciated by those skilled in the art that modifications may be made to the invention without departing from the concepts disclosed herein. For example, the number of feet 40 used can be more or less than three, depending on many factors, including the weight of the worksurface 16 and the desired structural integrity of the workplace apparatus 10. Such modifications are to be considered as included in the following claims, unless these claims by their language expressly state otherwise.

We claim:

1. An apparatus comprising:

a partition having a frame including a horizontally extending attachment feature;

a worksurface;

a bracket assembly supporting a rear edge of the worksurface to the frame at a selected location on the horizontally extending attachment feature, the bracket assembly including a partition-engaging bracket configured to securely engage the horizontally extending attachment feature, a worksurface-engaging bracket configured to securely engage the rear edge of the worksurface, and an interconnecting bracket; and the partition-engaging bracket and the interconnecting bracket including horizontally-extending overlapping flanges generally along a horizontal plane, and the worksurface-engaging bracket being configured to interlockingly secure the horizontally-extending overlapping flanges together in a vertically adjusted selected position.

2. An apparatus as set forth in claim 1, wherein:

the partition-engaging bracket includes horizontally extending feet for engagement with the horizontally extending attachment feature.

3. An apparatus as set forth in claim 1, wherein:

the horizontally-extending overlapping flanges of the partition-engaging bracket comprise vertically arranged ledges defined by depressions on a substantially planar face of the partition-engaging bracket.

4. An apparatus as set forth in claim 3, wherein:

the depressions are located on opposing sides of the partition-engaging bracket.

5. An apparatus as set forth in claim 1, wherein:

the worksurface-engaging bracket includes apertures for securing the worksurface-engaging bracket to the worksurface.

6. An apparatus as set forth in claim 1, wherein:

the interconnecting bracket comprises a recess;

wherein a vertical portion of the worksurface-engaging bracket and a vertical portion of the partition-engaging bracket fit within the recess and interlockingly secure the horizontally-extending overlapping flanges together in the vertically adjusted selected position.

7. An apparatus as set forth in claim 1, wherein:

the worksurface-engaging bracket is located between the partition-engaging bracket and the interconnecting bracket.

8. An apparatus as set forth in claim 1, wherein:

the partition-engaging bracket has a C-shaped cross section and wherein the horizontally-extending overlapping flanges of the partition-engaging bracket comprise vertically arranged shelves with associated slots for engagement with the horizontally-extending flanges of the interconnecting bracket.

9. An apparatus as set forth in claim 1, wherein:

the worksurface-engaging bracket includes a substantially C-shaped cross section and extensions on a worksurface-engaging face for attaching to lips on the interconnecting bracket.

10. An apparatus as set forth in claim 1, wherein:

the horizontally-extending overlapping flanges of the interconnecting bracket comprise vertically arranged inclined plates for engagement with the horizontally-extending flanges of the partition-engaging bracket.

11. An apparatus as set forth in claim 1, wherein:

the interconnecting bracket includes side walls with lips for attaching to extensions on the worksurface-engaging bracket.

12. An apparatus as set forth in claim 1, wherein:

the partition-engaging bracket is located between the worksurface-engaging bracket and the interconnecting bracket.

13. An apparatus as set forth in claim 1, wherein:

the partition-engaging bracket includes a locking tab for securely attaching the partition-engaging bracket to the horizontally extending attachment feature.

14. An apparatus comprising:

a partition having a frame including a horizontally extending attachment feature;

a worksurface;

a bracket assembly supporting a rear edge of the worksurface to the vertical frame at a selected location on the horizontally extending attachment feature, the bracket assembly including a partition-engaging bracket configured to securely engage the horizontally extending attachment feature, a worksurface-engaging bracket configured to securely engage the rear edge of the worksurface, and an interconnecting bracket; and the partition-engaging bracket and the interconnecting bracket including horizontally-extending overlapping flanges, and the worksurface-engaging bracket being configured to interlockingly secure the horizontally-extending overlapping flanges together in a vertically adjusted selected position;

wherein the horizontally-extending overlapping flanges of the interconnecting bracket comprise vertically arranged fingers for engagement with the horizontally-extending flanges of the partition-engaging bracket.

15. An apparatus comprising:

a partition having a frame including a horizontally extending attachment feature;

a worksurface;

a bracket assembly supporting a rear edge of the worksurface to the frame at a selected location on the horizontally extending attachment feature, the bracket assembly including a partition-engaging bracket configured to securely engage the horizontally extending attachment feature, a worksurface-engaging bracket configured to securely engage the rear edge of the worksurface, and an interconnecting bracket; and the partition-engaging bracket and the interconnecting bracket including horizontally-extending overlapping flanges, and the worksurface-engaging bracket being configured to interlockingly secure the horizontally-extending overlapping flanges together in a vertically adjusted selected position;

wherein the horizontally-extending overlapping flanges of the partition-engaging bracket comprise vertically arranged ledges defined by depressions on a substantially planar face of the partition-engaging bracket and the horizontally-extending overlapping flanges of the interconnecting bracket comprise vertically arranged fingers for engagement with the ledges of the partition-engaging bracket.

16. A bracket assembly comprising:

a partition-engaging bracket configured to securely engage a horizontally extending attachment feature on a frame of a partition;

a worksurface-engaging bracket configured to securely engage the rear edge of a worksurface;

an interconnecting bracket; and the partition-engaging bracket and the interconnecting bracket including horizontally-extending overlapping flanges generally along a horizontal plane, and the worksurface-engaging bracket being configured to interlockingly secure the horizontally-extending overlapping flanges together in a vertically adjusted selected position.

17. A bracket assembly as set forth in claim 16, wherein:

the partition-engaging bracket includes horizontally extending feet for engagement with the horizontally extending attachment feature.

18. A bracket assembly as set forth in claim 16, wherein:

the horizontally-extending overlapping flanges of the partition-engaging bracket comprise vertically arranged ledges defined by depressions on a substantially planar face of the partition-engaging bracket.

19. A bracket assembly as set forth in claim 18, wherein:

the ledges are located on opposing sides of the partition-engaging bracket.

20. A bracket assembly as set forth in claim 16, wherein:

the worksurface-engaging bracket includes apertures for securing the worksurface-engaging bracket to the worksurface.

21. A bracket assembly as set forth in claim 16, wherein:

the interconnecting bracket comprises a recess;

wherein a vertical portion of the worksurface-engaging bracket and a vertical portion of the partition-engaging bracket fit within the recess and interlockingly secure the horizontally-extending overlapping flanges together in the vertically adjusted selected position.

22. A bracket assembly as set forth in claim 16, wherein:

the worksurface-engaging bracket is located between the partition-engaging bracket and the interconnecting bracket.

23. A bracket assembly as set forth in claim 16, wherein:

the partition-engaging bracket has a C-shaped cross section and wherein the horizontally-extending overlapping flanges of the partition-engaging bracket comprise vertically arranged shelves with associated slots for engagement with the horizontally-extending flanges of the interconnecting bracket.

24. A bracket assembly as set forth in claim 16, wherein:

the worksurface-engaging bracket includes a substantially C-shaped cross section and extensions on a worksurface-engaging face for attaching to lips on the interconnecting bracket.

25. A bracket assembly as set forth in claim 16, wherein:

the horizontally-extending overlapping flanges of the interconnecting bracket comprise vertically arranged inclined plates for engagement with the horizontally-extending flanges of the partition-engaging bracket.

26. A bracket assembly as set forth in claim 16, wherein:

the interconnecting bracket includes side walls with lips for attaching to extensions on the worksurface-engaging bracket.

27. A bracket assembly as set forth in claim 16, wherein:

the partition-engaging bracket includes a locking tab for securely attaching the partition-engaging bracket to the horizontally extending attachment feature.

28. A bracket assembly as set forth in claim 16, wherein:

the partition-engaging bracket is located between the worksurface-engaging bracket and the interconnecting bracket.

29. A bracket assembly comprising:

a partition-engaging bracket configured to securely engage a horizontally extending attachment feature on a frame of a partition;

a worksurface-engaging bracket configured to securely engage the rear edge of a worksurface;

an interconnecting bracket; and the partition-engaging bracket and the interconnecting bracket including horizontally-extending overlapping flanges, and the worksurface-engaging bracket being configured to interlockingly secure the horizontally-extending overlapping flanges together in a vertically adjusted selected position;

wherein the horizontally-extending overlapping flanges of the interconnecting bracket comprise vertically arranged fingers for engagement with the horizontally-extending flanges of the partition-engaging bracket.

30. A bracket assembly comprising:

a partition-engaging bracket configured to securely engage a horizontally extending attachment feature on a frame of a partition;

a worksurface-engaging bracket configured to securely engage the rear edge of a worksurface;

an interconnecting bracket; and the partition-engaging bracket and the interconnecting bracket including horizontally-extending overlapping flanges, and the worksurface-engaging bracket being configured to interlockingly secure the horizontally-extending overlapping flanges together in a vertically adjusted selected position;

wherein the horizontally-extending overlapping flanges of the partition-engaging bracket comprise vertically arranged ledges defined by depressions on a substantially planar face of the partition-engaging bracket and the horizontally-extending overlapping flanges of the interconnecting bracket comprise vertically arranged fingers for engagement with the ledges of the partition-engaging bracket.

* * * * *